United States Patent [19]

Lumby et al.

[11] Patent Number: 4,919,162

[45] Date of Patent: Apr. 24, 1990

[54] DISHWASHER

[75] Inventors: David Lumby, Kingsgrove; Stephen Dawkins, Penshurst, both of Australia

[73] Assignee: McIlwraith Davey Pty. Ltd., Revesby, Australia

[21] Appl. No.: 102,339

[22] Filed: Sep. 29, 1987

[30] Foreign Application Priority Data

Sep. 29, 1986 [AU] Australia ..... PH8230

[51] Int. Cl.[5] ..... B08B 3/02

[52] U.S. Cl. ..... 134/115 R; 134/111; 134/179; 134/200; 134/180

[58] Field of Search ..... 134/111, 115, 175, 179, 134/198, 200, 172, 180, 103, 96, 175, 174

[56] References Cited

U.S. PATENT DOCUMENTS

| | | | |
|---|---|---|---|
| 1,658,413 | 2/1928 | Patelski | 134/115 |
| 2,632,452 | 3/1953 | Spitzer | 134/176 X |
| 3,323,529 | 6/1967 | Geiger et al. | 134/111 V |
| 3,358,702 | 12/1967 | Schaap | 134/115 R |
| 3,385,306 | 5/1968 | Brater et al. . | |
| 3,926,668 | 12/1975 | Ross | 134/179 |
| 3,961,984 | 6/1976 | Torressen | 134/115 R X |
| 4,005,723 | 2/1977 | Rosenberg | 134/180 X |
| 4,298,015 | 11/1981 | Garza . | |
| 4,420,005 | 12/1973 | Armstrong | 134/179 X |
| 4,638,826 | 1/1987 | Canosa | 134/115 R X |

FOREIGN PATENT DOCUMENTS

| | | | |
|---|---|---|---|
| 7017774 | 3/1970 | Fed. Rep. of Germany . | |
| 53-9066 | 1/1978 | Japan | 134/115 R |

*Primary Examiner*—Frankie L. Stinson

*Attorney, Agent, or Firm*—Fitch, Even, Tabin & Flannery

[57] ABSTRACT

A sink located dishwasher is disclosed having a cover for the sink, a rack for dishes locatable in the sink, and a removable spray arm assembly mounted in the sink drain. The spary arm assembly includes a spray arm rotatably mounted at the upper end of a hollow shapft to rotate in the sink below the rack. A pair of seals are provided on the shaft to seal the shaft within the drain. Water is pumped from the drain above both seals and returned to the drain between the seals from where it flows up the hollow shaft and rotates the spray arm.

13 Claims, 4 Drawing Sheets

Figure 1:
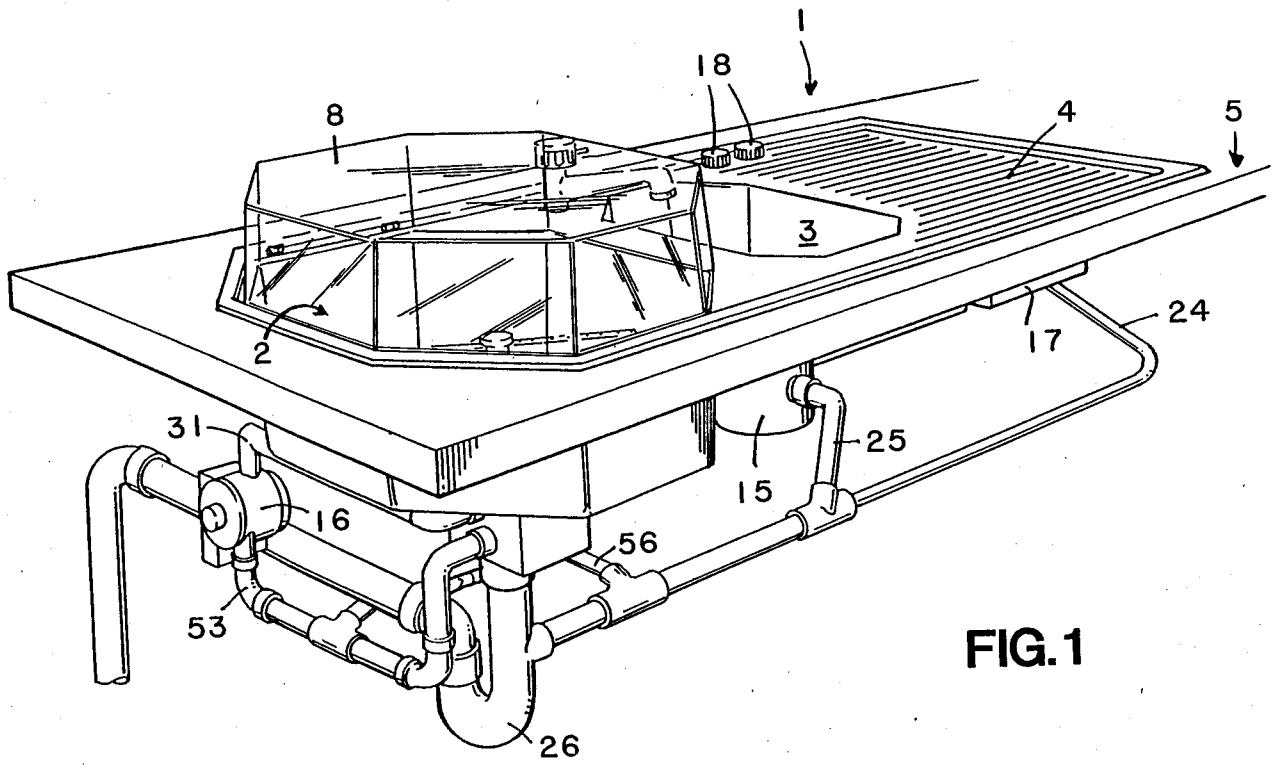

DISHWASHERThe present invention relates to dishwashers and, in particular, to sink mounted dishwashers.

Such dishwashers are well known and represent an attractive commerical proposition, especially for domestic use, since the cost of such sink mounted dishwashers is substantially less than the cost of a conventional dishwasher.

Sink mounted dishwashers are disclosed in U.S. Pat. Nos. 3,961,984 (Torresen) and 4,420,005 (Armstrong). Such dishwashers suffer from the problem of use of the mains water pressure to power the rotating spray arm used to cleanse the dishes and utensils. While this arrangement may be satisfactory in those localities having a high local water pressure, there are substantial disadvantages if the water pressure is relatively low. Such problems arise in the upper stories of high rise buildings.

Another prior art dishwasher is that disclosed in Australian Patent Application No. 37,530/85 (Rokach) which corresponds to European Patent Application No. 85 100218.8 published under No. 0150 734. This arrangement suffers from a number of disadvantages including some water possibly remaining in the sink at the completion of the dishwashing procedure, the possibility that the electric connections to the dishwasher may become wet in use, and the problem that the highest level of water able to be tolerated within the sink is above the water inlet and thus there is a potential problem of contaminated water from within the sink mixing with clean mains water and thereby contaminating the water mains.

A further problem of many prior art sink mounted dishwashers is that the complete apparatus is not confined in plan to the area occupied by a conventional sink. Thus installation without altering the kitchen layout, or modifying adjacent benchtops, is impossible.

Further prior art sink mounted dishwashers include those disclosed in U.S. Pat. Nos. 3,863,657 (Irving); 3,595,253 (Yanez-Pastor); 3,230,961 (Benkert et al); 3,469,586 (Berson) and 4,444,213 (Taylor). These arrangements suffer from the disadvantage that it is difficult to convert the sink from conventional operation to dishwashing operation.

It is the object of the present invention to overcome, or ameliorate, some of the abovementioned disadvantages by the provision of a sink located dishwasher which is of relatively low cost construction and improved operation.

Figure 2:
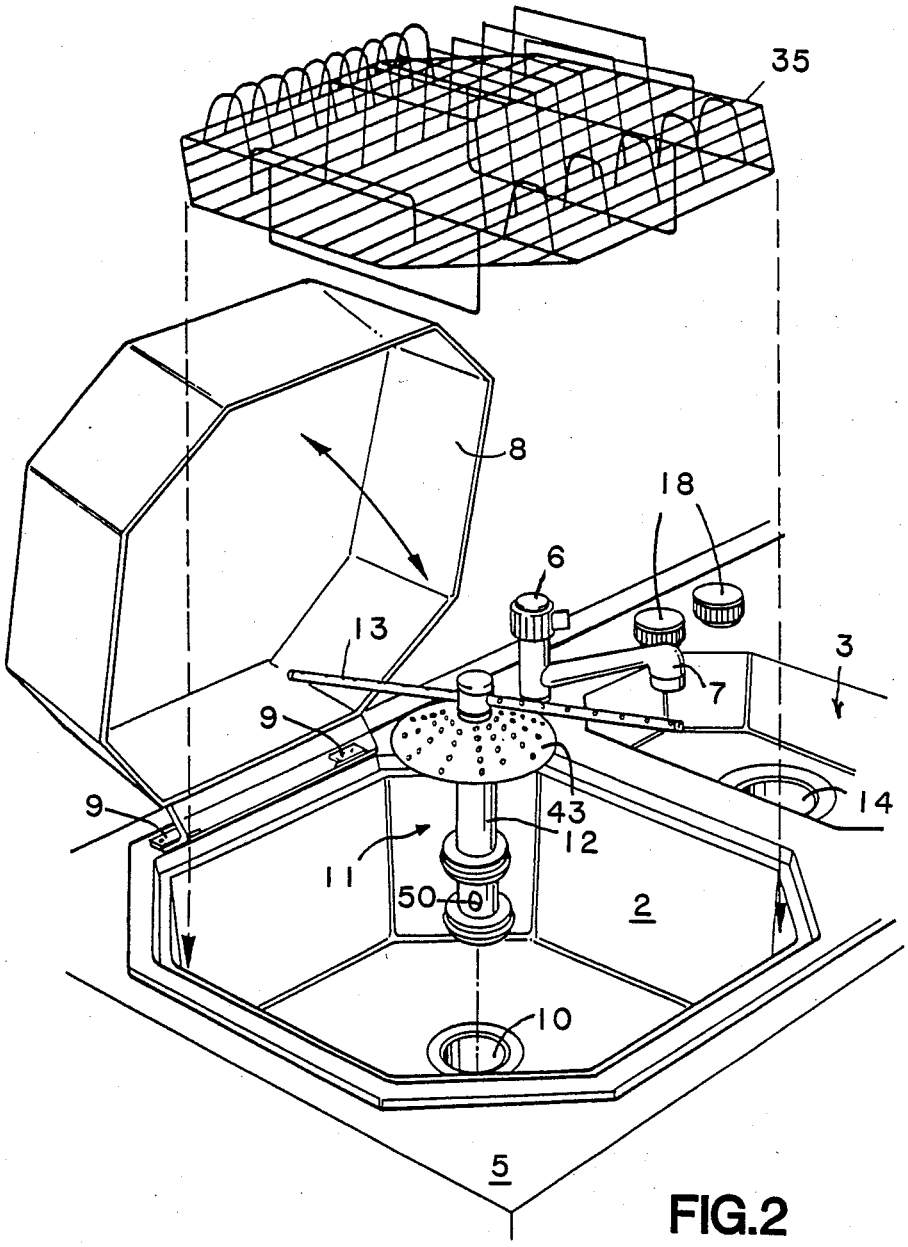
Figure 3:
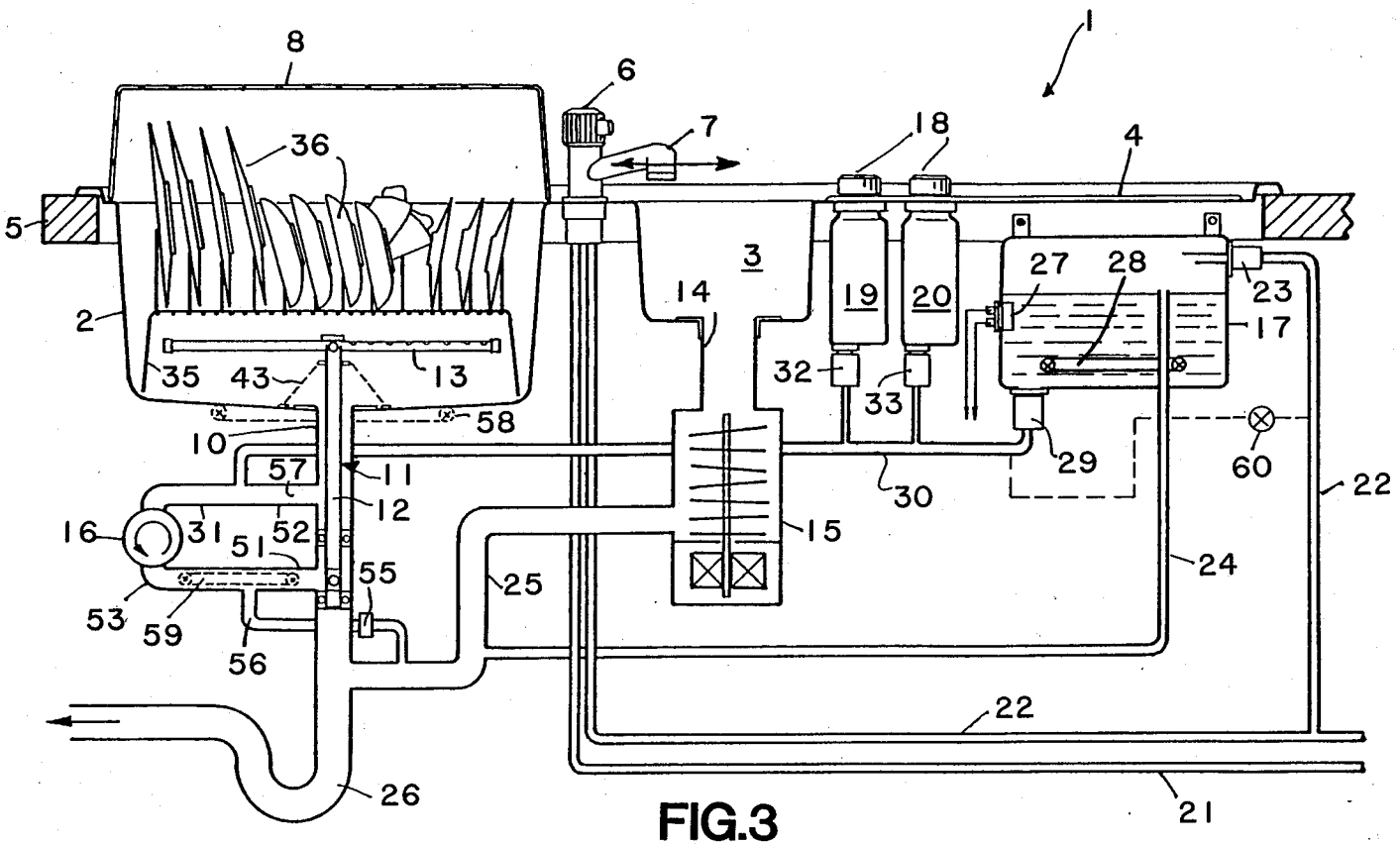
Figure 4:
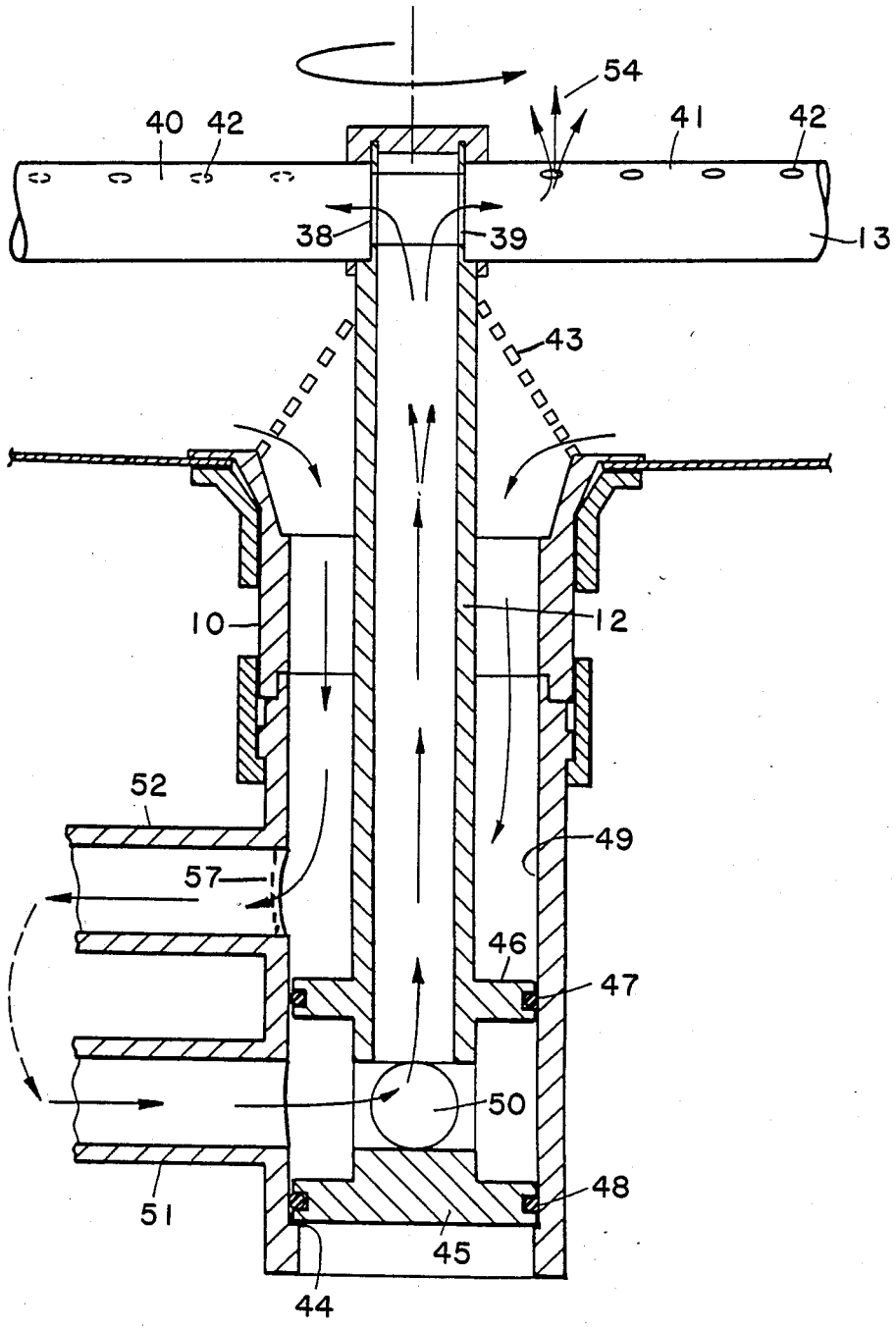

According to one aspect of the present invention there is disclosed a sink located dishwasher having a water supply means to supply water to the sink, a rack for dishes and utensils located in the sink, a drain located in the base of the sink, a cover for the sink, and a water spray arm located above the base of the sink, rotatable within the sink, and mounted for rotation at the upper end of a shaft having a hollow interior releasably mounted in said drain, water outlet means associated with said drain to direct water to a pump, and water inlet means communicating between the interior of said shaft and said pump to return water into said sink via said water spray arm whereby said spray is rotatable by said return water. One embodiment of the present invention will now be described with reference to the drawings in which:

FIG. 1 is a perspective view of the twin sink of the preferred embodiment,

FIG. 2 is an exploded perspective view of the dishwashing apparatus insertable within the larger of the two sinks, FIG. 3 is a schematic arrangement indicating the plumbing interconnections of the various components of the dishwasher, and FIG. 4 is a longitudinal vertical cross-sectional view through the spray arm and drain of the larger sink. As seen in FIG. 1, the twin sink 1 of the preferred embodiment comprises a large sink 2, a small sink 3 and a draining board 4 preferably pressed from a single piece of stainless steel. The sink 1 is mounted in a bench 5. A single faucet 6 is mounted between the two sinks 2,3 and has a pivotable spout 7 able to be moved so as to direct water into either one of the sinks 2,3.

As best seen in FIG. 2, the sink 2 is provided with a cover 8 with is pivotable so as to permit access to the sink 2 or enclose its contents. The cover is preferably provided with conventional releasable hinges 9 to permit the cover to be completely removed from the sink 2 if desired. The sink 2 has a drain 10 into which a spray assembly 11 having a hollow shaft 12 and spray arm 13 is able to be removably inserted.

The sink 3 is also provided with a drain 14 which leads to a waste disposal unit 15 (FIGS. 1 and 3). A rack 35 for dirty dishes and utensils is also provided.

As best seen in FIG. 1, a pump 16 is located under the sink 1 and a hot water tank 17 is located under the draining board 4. Adjacent the draining board 4 are a pair of caps 18 which enable respective liquid containers 19, 20 (FIG. 3) to be filled with liquid detergent and liquid rinse aid respectively.

The plumbing interconnections between the various components are illustrated in FIG. 3. A cold water supply line 21 is connected to the faucet 6 as is a hot water supply line 22. The hot water supply line 22 is also connected to the tank 17 via a solenoid valve 23. The tank 17 is also provided with an overflow pipe 24 which is connected to the outlet 25 of the waste disposal unit 15 and thence to an S-trap 26 in the drain 10. It will be appreciated that there is a height difference between the hot water inlet to the tank 17 and the overflow pipe 24 which therefore ensures that there can be no contamination of the mains water supply.

The tank 17 is also provided with a level detector 27 and an electric heating element 28. In the base of the tank 17 is a solenoid valve 29 which connects the tank 17 via a supply pipe 30 to the inlet 31 of the pump 16.

Each of the containers 19,20 is provided with a corresponding solenoid valve 32,33 which connects the containers 19,20 to the supply pipe 30.

It will be apparent from FIG. 3 that the sink 2 can be loaded with the rack 35 containing dishes 36 to be cleaned. The spray arm 13 is able to rotate clear of the underside of the rack 35. The cover 8 when closed over the sink 2 also clears the dishes 36 and forms a substantially sealed enclosure.

The pump 16 has an outlet 53 which is connected to the drain 10 and also via a solenoid valve 55 in connecting pipe 56 to the waste disposal unit outlet.

The details of the spray assembly 11 and drain 10 will now be described with reference to FIG. 4. The spray arm 13 is hollow and is rotatably mounted at the upper end of the shaft 12. Two openings 38,39 in the respective arms 40 and 41 of the spray arm 13 lead to the hollow interior of the shaft 12. Extending along the upper surface of each of the arms 40,41 is a row of holes 42 which are offset from the center top of the arms 40,41 and are inclined in opposite directions so as to cause the spray arm 13 to rotate in the direction indicated by the arrow in FIG. 4, when water passes through the openings 38,39 into the arms 40,41 and thence out the holes 42.

As best seen in FIGS. 2 and 4, a conical plastic filter 43 is positioned around the shaft 12 and abuts the rim of the drain 10 when the spray assembly 11 is in the operative position illustrated in FIG. 4.

The drain 10 is provided with a shoulder 44 against which a disc 45 at the lower end of the shaft 12 abuts. Spaced from the disc 45 is a collar 46 and the disc 45 and collar 46 each carry a respective 0-ring 47,48. The 0-rings 47,48 form a seal with the interior surface 49 of the drain 10 yet enable the spray assembly 11 to be slidingly removed from the drain 10.

Between the disc 45 and collar 46, the hollow shaft 12 is provided with an opening 50 which, when the spray assembly 11 is in the operative position illustrated in FIG. 4, is substantially level with an inlet 51 to the drain 10. Similarly, located above the collar 46 when the spray assembly 11 is in the operative position illustrated in FIG. 4 is an outlet 52 in the drain 10. The outlet 52 is provided with a filter 57 to prevent the outlet 52 being blocked by debris when the sink 2 is used conventionally. It will be apparent from FIG. 3 that the outlet 52 in the drain 10 is connected to the pump inlet 31 while the inlet 51 in the drain 10 is connected to the pump outlet 53.

The preferred form of operation of the dishwasher of the preferred embodiment will now be described. With the spray assembly in the operative position illustrated in FIG. 4, the dishes 36 to be cleaned are loaded onto the rack 35 and placed within the sink 2. The cover 8 is then closed. Hot water is introduced via solenoid 23 into the tank 17 and this filling operation continues until interrupted by the level detector 27. The heating element 28 is then energized to heat the water contained within the tank 17 to a temperature higher than that normally used for domestic hot water supplies.

After this heating has taken place, the solenoid valve 29 is opened thereby allowing the heated water to drain under the influence of gravity through the supply pipe 30 and thence via the drain outlet 52 into the drain 10 so as to fill the lower portion of the sink 2 below the height of the spray arm 13. During this draining operation the solenoid valve 32 is opened for a short period to discharge a quantity of liquid detergent from the container 19 into the hot water.

Then the pump 16 is operated so as to take water from the sink 2 down the drain 10, through the drain outlet 52, and into the pump inlet 31. Pressurized water then passes through the pump outlet 53 and into the drain inlet 51 where it passes through the opening 50 and thence upwardly along the hollow interior of the shaft 12. The pressurized water passes through the openings 38, 39 and into the arms 40,41 finally being ejected via the holes 42 in the form of a spray 54 which passes over the dishes 36 and strikes the cover 8. The water then falls downwardly into the base of the sink 2. Because of the mis-alignment of the holes 42, the spray 54 causes the spray arm 13 to rotate thereby directing the spray 54 onto all of the dishes 36.

Food debris and other particles which fall from the dishes 36 are prevented from entering the drain 10 by the filter 43.

At the completion of the washing cycle, solenoid valve 55 is opened thereby allowing water from the pump outlet 53 to drain or be pumped through connecting pipe 56 and into the S-trap 26. After all the water has been drained from the sink 26, the solenoid valve 55 is closed and the solenoid valve 27 is opened thereby allowing a fresh charge of hot water to again enter the sink 2. On this occasion, the solenoid valve 33 is opened for a predetermined time thereby allowing a predetermined quantity of rinse aid liquid to be introduced into the hot water which enters the sink 2. Pump 16 is again operated in order to carry out a rinsing cycle and at the end of this cycle, the solenoid valve 55 is again opened to drain the rinse water. It will be apparent to those skilled in the art that this preferred method of operation enables a number of washing cycles and a number of rinsing cycles to be carried out as desired. At the end of the washing process, the cover 8 is opened and the dishes 36 removed.

If it is desired to use the sink 2 in conventional fashion, the rack 35 and spray assembly 11 are then removed from the sink 2. Alternatively, another load of dishes can be inserted into the rack 35 and the washing procedure repeated.

It will also be apparent to those skilled in the art that the apparatus described above can be operated in a different fashion. For example, if only preliminary rinse of dishes 36 is required, then with the cover open and spray assembly 11 in place, the spout 7 can be swung over the sink 2 and the sink 2 filled with hot water from faucet 6 to a level just below the spray arm 13. Then the pump 16 can be operated so as to rinse or wash the dishes 36 with the cover 8 closed. At the end of this cycle, the dishes 36 and rack 35 can be removed and the sink drained, if desired, by simply removing the spray assembly 11.

Several modifications to the above described apparatus, as indicated by broken lines in FIG. 3, are possible. For example, the heating element 28 instead of being located within the tank 17 can be welded to 58. Such an element can be utilized to assist in drying the dishes 36. Alternatively, or additionally, a heating element 59 can also be located in-line within the pump outlet 53, for example. This arrangement is particularly advantageous if the hot water tank 17 is dispensed with. This is possible if a non-return solenoid valve 60 is available in which case the supply pipe 30 can be directly connected to the hot water supply line 22 via the non-return solenoid valve 60. The valve 60 is then operated in lieu of the valve 29.

The foregoing describes only one embodiment of the present invention and modifications, obvious to those skilled in the art, can be made thereto without departing from the scope of the present invention.

What we claim is:

1. A sink located dishwasher having a water supply means to supply water to the sink, a rack for dishes and utensils located in the sink, a drain located in the base of the sink, a cover for the sink, a water spray arm located above the base of the sink and removably mounted above said drain, water outlet means in communication with the drain to direct water to a pump, water inlet means located in said drain to direct water from said pump to said spray arm, the water inlet means being removably insertable into the drain, and a releasable obstruction included in said drain below said water outlet means.

2. The dishwasher as claimed in claim 1, wherein said water supply means comprises a faucet located above said sink.

3. The dishwasher as claimed in claim 2 wherein said faucet is not located underneath said cover and includes a spout pivotable between a sink filling position and a position clear of said cover.

4. The dishwasher as claimed in claim 1 wherein said obstruction is releasable by being removed with said water inlet means.

5. The dishwasher as claimed in claim 4 wherein said water spray arm is rotatably mounted and said pump returns water from said drain into said sink via said water inlet means to said water spray arm whereby said spray arm is rotatable by said returned water.

6. The dishwasher as claimed in claim 1 wherein said water spray arm is rotatably mounted and said pump returns water from said drain into said sink via said water inlet means to said water spray arm whereby said spray arm is rotatably by said returned water.

7. The dishwasher as claimed in claim 1 wherein said drain is a pipe having a substantially constant internal diameter and said water inlet means comprises a hollow shaft which carries a pair of spaced apart seals having a diameter substantially equal to said drain internal diameter, said shaft being removably insertable into an operative position within said drain by sliding said seals along said drain.

8. The dishwasher as claimed in claim 7 wherein an opening leading into said hollow shaft is located between said seals, said drain has a water inlet located between said seals when said shaft is in its operative position and a water outlet located above both seals when said shaft is its operative position, and said pump has an outlet and an inlet which are respectively connected to said water inlet and outlet of said drain.

9. The dishwasher as claimed in claim 8 wherein said water supply means comprises a water supply pipe connected with said pump inlet.

10. The dishwasher as claimed in claim 9 wherein at least one of a detergent dispenser and a rinse aid dispenser is connected to said water supply pipe.

11. The dishwasher as claimed in claim 9 including a water supply tank having an inlet located above an overflow outlet, and draining into said water supply pipe.

12. The dishwasher as claimed in claim 11 wherein said sink has a draining board and said water supply tank is located below said draining board and above the base of said sink whereby said sink can be at least partially filled with water drained from said tank.

13. The dishwasher as claimed in claim 1 wherein a filter is positioned in the flow of water into said drain and is operative to filter the water entering said pump.

* * * * *

UNITED STATES PATENT AND TRADEMARK OFFICE

CERTIFICATE OF CORRECTION

PATENT NO. : 4,919,162

DATED : April 24, 1990

INVENTOR(S) : David Lumby et al.

It is certified that error appears in the above-identified patent and that said Letters Patent is hereby corrected as shown below:

ON THE TITLE PAGE

In the Abstract, line 4, change "spary" to --spray--.
line 5, change "shapft" to --shaft--.

Column 1, line 1, center the heading "DISHWASHER" on line by itself.

Column 1, line 1, before "The Present Invention", begin new paragraph.

Column 1, line 7, change "commerical" to --commercial--.

Column 1, line 64, begin new paragraph with "One embodiment . . .".

Column 2, line 8, begin new paragraph with "As seen in Fig. 1 . . .".

Column 2, line 17, change "with" to --which--.

Column 2, line 32, after "aid" insert --,-- (comma).

Column 4, line 26, after "cover" insert --8--.

Column 4, line 38, after "welded to" insert --the under surface of the sink 2 in the position of element--.

UNITED STATES PATENT AND TRADEMARK OFFICE

CERTIFICATE OF CORRECTION

PATENT NO. : 4,919,162

DATED : April 24, 1990

INVENTOR(S) : David Lumby et al.

It is certified that error appears in the above-identified patent and that said Letters Patent is hereby corrected as shown below:

Column 4, line 39, after "can" insert --also--.Column 5, line 18, change "rotatably" to --rotatable--.

Column 6, line 6, between "is" and "its" insert --in--.

Signed and Sealed this

Third Day of March, 1992

*Attest:*

*Attesting Officer*

HARRY F. MANBECK, JR.

*Commissioner of Patents and Trademarks*